United States Patent [19]

Endo et al.

[11] 4,362,409

[45] Dec. 7, 1982

[54] AUTOMATIC SHEET FEEDING SYSTEM OF A PRINTING APPARATUS

[75] Inventors: Kazuhiro Endo, Atsugi; Toshiyuki Soejima, Yamato; Masahiro Fujihara, Kofu, all of Japan

[73] Assignees: Ricoh Co., Ltd.; Nipponseimitsu Kogyo Kabushiki Kaisha, both of Japan

[21] Appl. No.: 172,958

[22] Filed: Jul. 28, 1980

[30] Foreign Application Priority Data

Sep. 11, 1979 [JP] Japan ..... 54-115723

[51] Int. Cl.[3] ..... B41J 11/58; B65H 9/04

[52] U.S. Cl. ..... 400/625; 400/632; 400/642; 271/245; 271/258

[58] Field of Search ..... 400/624-625, 400/629-630, 631, 632, 632.1, 633, 633.1, 633.2, 636, 636.1, 636.2, 637, 637.1, 637.2, 639, 639.1, 639.2, 642, 646-649; 271/3, 3.1, 109, 37-38, 110, 126, 227-228, 245, 258, 265

[56] References Cited

U.S. PATENT DOCUMENTS

| | | | |
|---|---|---|---|
| 2,135,541 | 11/1938 | Stuart et al. | 400/630 |
| 2,887,207 | 5/1979 | Schmidt et al. | 400/632 |
| 3,430,748 | 3/1969 | Parri | 400/625 X |
| 3,519,117 | 7/1970 | Smith | 400/639.1 X |
| 4,089,402 | 5/1978 | Hyland et al. | 400/625 |
| 4,189,135 | 2/1980 | Costa | 400/625 X |
| 4,212,456 | 7/1980 | Ruenzi | 400/625 |
| 4,221,374 | 9/1980 | Koch et al. | 400/625 X |
| 4,268,021 | 5/1981 | Rutishauser et al. | 400/625 X |
| 4,273,456 | 6/1981 | Bisczat et al. | 400/639.1 X |
| 4,275,969 | 6/1981 | Matsuhisa et al. | 400/625 |

FOREIGN PATENT DOCUMENTS

| | | | |
|---|---|---|---|
| 2711173 | 10/1977 | Fed. Rep. of Germany | 400/625 |
| 2716396 | 10/1978 | Fed. Rep. of Germany | 400/632 |

OTHER PUBLICATIONS

"Cartridge Sheet Feed", IBM Tech. Discl. Bulletin, vol. 21, No. 12, May 1979, pp. 4753-4754.

"Paper Feed", IBM Tech. Discl. Bulletin, vol. 18, No. 5, Oct. 1975, pp. 1305-1306.

"Gate Mechanism", IBM Tech. Discl. Bulletin, vol. 21, No. 9, Feb. 1979, pp. 3535-3537.

"Paper Guide Assembly for Delivering & Receiving Sheets", IBM, Tech. Discl. Bulletin, vol. 19, No. 9, Feb. 1977, p. 3470.

*Primary Examiner*—E. H. Eickholt

*Attorney, Agent, or Firm*—McGlew and Tuttle

[57] ABSTRACT

An automatic sheet feeding system of a printing apparatus comprising a platen, a printing head, a sheet ejecting stacker and a sheet feeding stacker. The platen remains stationary when the leading edge of a sheet fed by the sheet feeding roller has abutted against the platen, whereby the tilting position of the sheet can be corrected. The system comprises further sheet leading edge detecting means disposed at the inlet of the sheet ejecting passage near the platen. When the detecting means detects the leading edge of a sheet, the platen can be rotated in the reverse direction through a predetermined angle for setting the printing initiating position on a sheet at a predetermined distance from the leading edge of the sheet.

11 Claims, 19 Drawing Figures

AUTOMATIC SHEET FEEDING SYSTEM OF A PRINTING APPARATUS

FIELD AND BACKGROUND OF THE INVENTION

This invention relates to an automatic sheet feeding system of a printing apparatus comprising a printing head disposed on the front side of the platen for movement axially thereof, and a sheet ejecting stacker and a sheet feeding stacker arranged one above the other in the indicated order from above rearwardly of the platen.

A known automatic sheet feeding system of the type described above comprises a sheet feeding roller of the sheet feeding stacker and a sheet ejecting roller of the sheet ejecting stacker arranged adjacent the platen, wherein the platen is driven by the drive of the printing apparatus or by a built-in motor and rotation of the platen is transmitted to the sheet feeding roller and sheet ejecting roller via a clutch.

In the known automatic sheet feeding system referred to hereinabove, the platen is already rotating when a sheet on the sheet feeding stacker is fed by the sheet feeding roller. If the sheet fed is not in a regular position but in a tilting position, for example, then the sheet is mounted in the tilting position on the platen and printing is carried out on the sheet which is not in the regular position. Correction of the sheet in an irregular position requires special parts and renders the sheet feeding system complex in construction.

In the aforesaid type of automatic sheet feeding system, it is well known that difficulties are encountered in setting the printing initiating position on a sheet at a predetermined distance from the leading edge of the sheet. It is necessary to detect, in the aforesaid automatic sheet feeding system, whether or not a sheet has been fed on the platen, and the detecting device is arranged at the inlet of a sheet ejecting passage adjacent the platen so that such device may not interfere with checking of the printed letters or manually feeding of a sheet. When the leading edge of a sheet is detected by the detecting device, the desired printing initiating position would have already passed by the printing means. Thus if printing were carried out in this condition, a large blank space would be present on the sheet between the leading edge of the sheet and the position in which printing is actually started or an unprintable zone of a large area would be formed in the upper margin of the sheet.

Additionally, in the aforesaid automatic sheet feeding system, when a sheet is fed manually, it is necessary to remove the automatic sheet feeding system as a whole from the sheet feeding section of the printing apparatus. This operation is troublesome.

SUMMARY OF THE INVENTION

This invention has as its object the provision of an automatic sheet feeding system of a printing apparatus which obviates the aforesaid and other disadvantages of the prior art.

The aforesaid object of the invention can be accomplished by providing, in an automatic sheet feeding system, a guide member arranged close to the platen in such a manner that a sheet ejecting passage connected to a sheet ejecting stacker is formed at a higher level and a sheet feeding passage connected to a sheet feeding stacker is formed at a lower level, a motor for driving a sheet feeding roller for feeding one sheet after from the sheet feeding stacker, a pinch roller cooperating with the platen for feeding a sheet, and a transmission means for transmitting rotation from a drive of the printing apparatus to the platen, so that rotation of the platen is initiated only after the leading edge of a sheet fed by the sheet feeding roller has abutted against a holding section formed between the platen which remains stationary and the pinch roller. By this arrangement, it is possible to automatically correct by a simple construction the position of a sheet fed to the platen.

According to the invention, there is also provided, in an automatic sheet feeding system, sheet leading edge detecting means at the inlet of the sheet ejecting passage near the platen so that when the detecting means detects the leading edge of a sheet the platen can be rotated in the reverse direction through a predetermined angle. In this way, the sheet leading edge detecting means is utilized for setting the printing initiating position on a sheet in such a manner that the sheet leading edge moves rearwardly a predetermined distance from the detecting position. By this arrangement, a large blank space in the upper margin of a sheet and variations in the printing initiating position on a sheet can be eliminated to enable printing to be commenced in a predetermined position on all the sheets.

The invention also proposes to form in the guide member a slit for manually feeding sheets. This enables a sheet to be manually mounted on the platen by merely flipping the cover upwardly.

BRIEF DESCRIPTION OF THE DRAWINGS

Additional and other objects, features and advantages of the invention will become apparent from the description set forth hereinafter when considered in conjunction with the accompanying drawings, in which.

DETAILED DESCRIPTION

Figure 1:
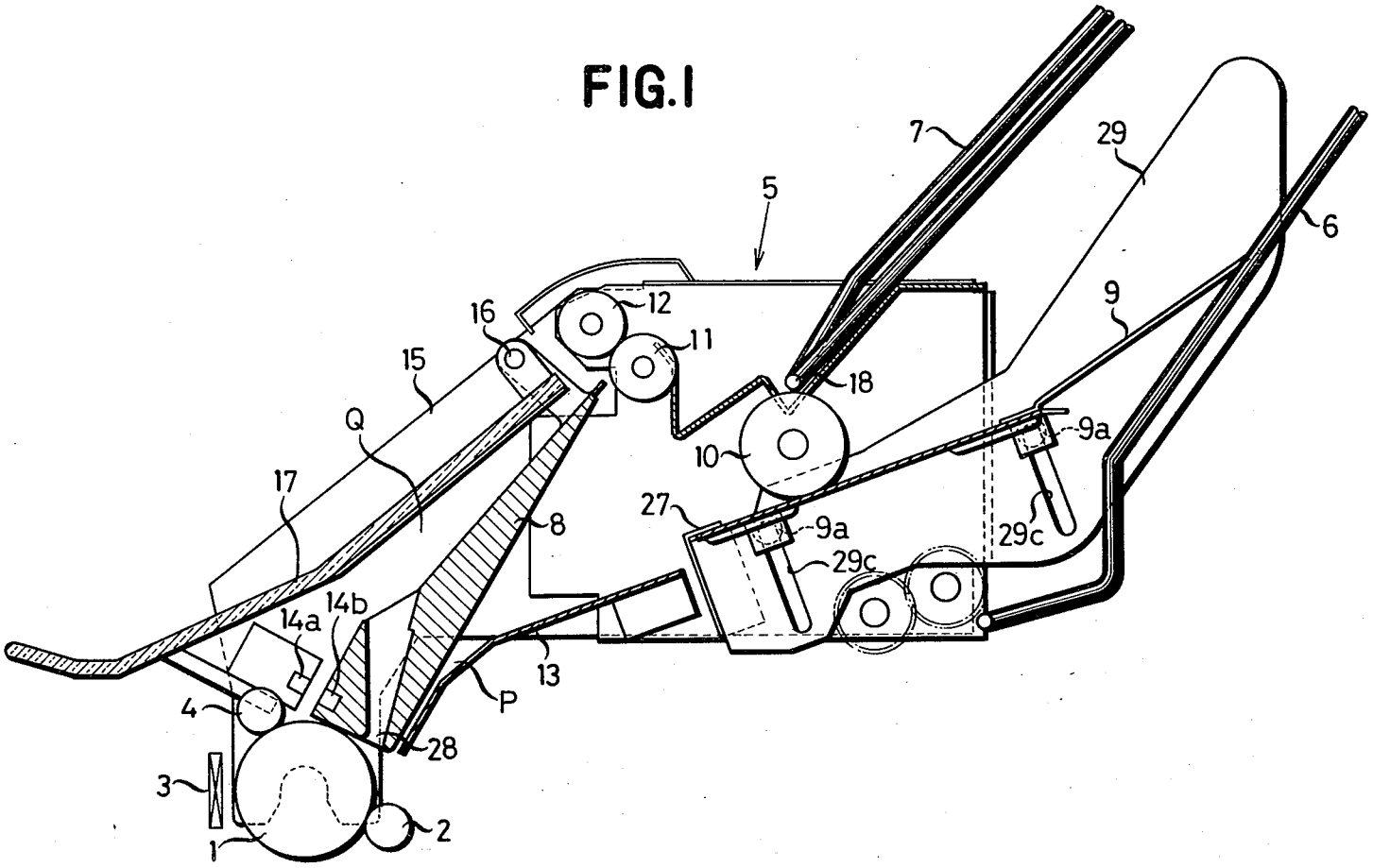
FIG. 1 is a schematic sectional view of the automatic sheet feeding system comprising one embodiment of the invention.

In FIG. 1, a platen 1 of the printing apparatus is provided with a pinch roller 2, a printing head 3 and a paper bail 4. The automatic sheet feeding system according to the invention generally designated by the numeral 5 is mounted on the sheet feeding section of the printing apparatus and comprises a sheet feeding stacker 6, a sheet ejecting stacker 7 and a guide member 8. The sheet feeding stacker 6 has attached thereto a sheet support plate 9 for supporting the forward end of a stack of sheets on the stacker 6, and a sheet feeding roller 10 in contact with the uppermost sheet of the stack of sheets for feeding same to the platen 1. At the inlet of the sheet ejecting stacker 7 there is arranged a pair of sheet ejecting rollers 11 and 12 holding therebetween a sheet transported along the upper surface of the guide member 8 and ejecting same onto the sheet ejecting stacker 7. Reference numeral 13 designates a guide plate, and 14*a* and 14*b* designate sheet leading edge detecting means for detecting whether or not a sheet is fed on the platen 1 or for effecting what is referred to as detection of a jam. The detecting means 14*a* and 14*b* are connected to a jam circuit, not shown. Reference numeral 27 designates separation claws, and numeral 29 is a pair of guide side plates.

The automatic sheet feeding system 5 has a support shaft 16 secured to a machine frame 15 for pivotally supporting one end of a cover 17 and the guide member 8, so that the cover 17 and guide member 8 can be pivotally flipped upwardly about the support shaft 16. When disposed in the lower or closed position as shown, the cover 17 and guide member 8 are held in the operative position by suitable stoppers, not shown. Particularly, the guide member 8 is disposed such that a sheet feeding passage P and a sheet ejecting passage Q are defined by the guide plate 13, platen 1 and cover 17 cooperating with the guide member 8. When the cover 17 is flipped upwardly about the support shaft 16, the sheet ejecting passage Q is opened; and when the guide member 8 is flipped upwardly, the sheet feeding passage P is opened. By this arrangement, it is possible to readily cope with any sheet jam which might take place in one of the passages.

The sheet ejecting stacker 7 is pivotally supported by a support shaft 18 secured to the machine frame 15, so that the sheet ejecting stacker 7 can be pivotally flipped from its operative position shown to an inoperative position by moving same counterclockwise about the support shaft 18. Thus, when the sheet ejecting stacker 7 is flipped upwardly, the upper portion of the sheet feeding stacker 6 is opened, thereby facilitating supply of a stack of sheets to the sheet feeding stacker 6. This enables the spacing between the sheet feeding stacker 6 and sheet ejecting stacker 7 to be minimized when the sheet ejecting stacker 7 is in its operative position shown in FIG. 1.

The guide member 8 is formed with a slit 28 extending therethrough and crosswise. By flipping the cover 17 upwardly in pivotal movement about the support shaft 16, it is possible to manually feed a sheet on the platen 1 through the slit 28. To enable manual feeding of a sheet, the slit 28 has a width which corresponds to the maximum width of a sheet handled. As described hereinabove, the automatic sheet feeding system 5 includes a drive motor for rotating the sheet feeding roller 10. When manual feeding of a sheet is carried out, the drive motor is shut down and automatic sheet feeding is interrupted. Thus, a sheet can be manually fed on the platen 1 by merely pivotally moving the cover 17 upwardly without requiring to remove the automatic sheet feeding system from the printing apparatus.

Figure 2:
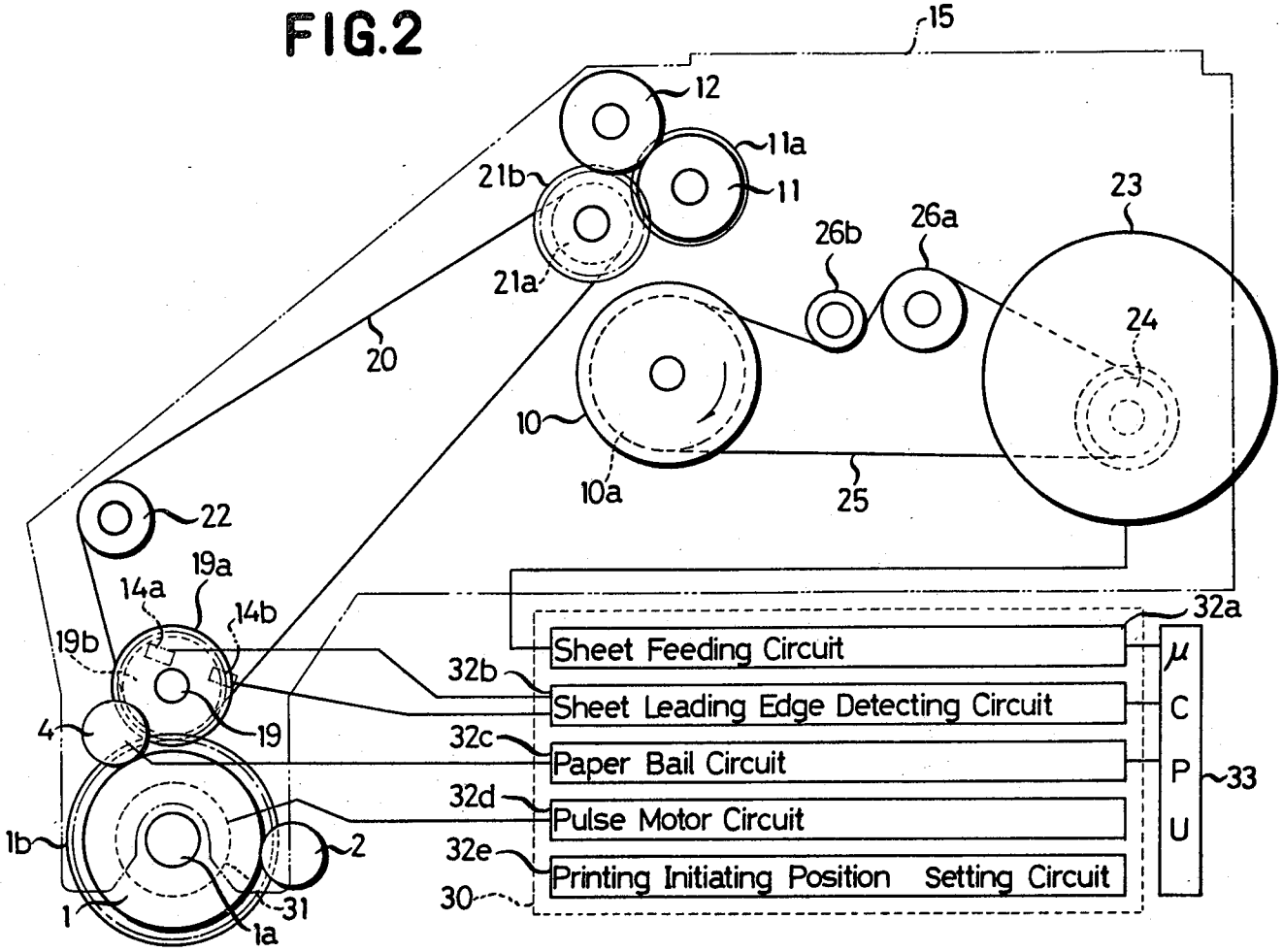
FIG. 2 is a schematic view of the drive system including a platen, a sheet feeding roller and a pair of sheet ejecting rollers.

Referring to FIG. 2, the platen 1 is supported by a shaft 1*a* connected to a pulse motor 31 of the printing apparatus and formed with a gear 1*b* in meshing engagement with a gear 19*a* formed on a shaft 19. The shaft 19 has a pulley 19*b* secured thereto and having a belt 20 trained over it. Thus, rotation of the platen 1 is transmitted to one sheet ejecting roller 11 via the gear 1*b*, gear 19*a*, pulley 19*b*, belt 20, a pulley 21*a*, a gear 21*b* coaxial with pulley 21*a* and secured thereto, and a gear 11*a* of the sheet ejecting roller 11 meshing with gear 21*b*. The other sheet ejecting roller 12 is rotated by frictional engagement with the sheet ejecting roller 11. Numeral 22 designates an intermediate pulley.

The automatic sheet feeding system 5 includes a drive motor 23 which drives, through a speed reducing gear train, a pulley 24, a belt 25 and a pulley 10*a* of the sheet feeding roller 10, to rotate the sheet feeding roller 10 in the direction of an arrow. Numerals 26*a* and 26*b* represent intermediate pulleys, and numeral 30 represents a control circuit including a sheet feeding circuit 32*a*, a sheet leading edge detecting circuit 32*b*, a paper bail circuit 32*c*, a pulse motor circuit 32*d* for driving the platen 1 and a printing initiating position setting circuit 32*e*. These circuits are controlled via a μCPU 33.

Figure 3:
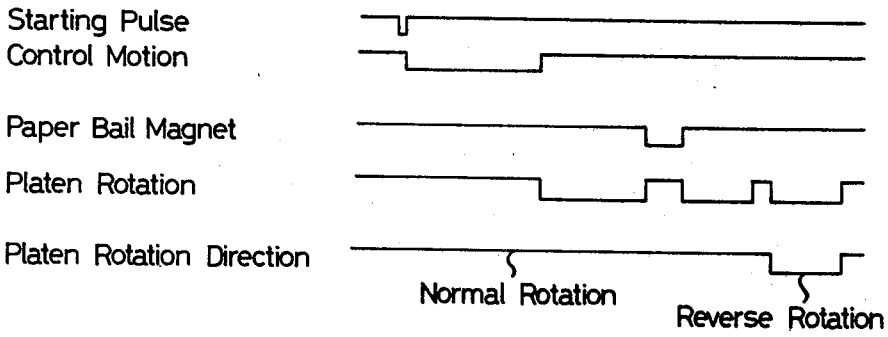
FIG. 3 is a time chart in explanation of the operation of the automatic sheet feeding system shown in FIG. 1 and 2.

Operation of the automatic sheet feeding system 5 of the aforesaid construction will be described by referring to the time chart shown in FIG. 3. Depression of a start switch produces a starting pulse shown in FIG. 3 which actuates the sheet feeding circuit 32*a* and rotates the drive motor 23, to rotate the sheet feeding roller 10 in the direction of the arrow via the belt 25. By this action of the sheet feeding roller 10, the uppermost sheet of the stack of sheets on the sheet support plate 9 is fed to the platen 1 via the sheet feeding passage P on the guide plate 13. At this time, the platen 1 and the pinch roller 2 are still stationary and not rotating. Therefore, the sheet abuts at its leading edge against a holding section formed between the platen 1 and pinch roller 2 and stops. If the sheet is not in a regular position, the position of the sheet is corrected so that the entire leading edge of the sheet is positioned against the holding section. Then the sheet feeding circuit 32*a* is reset and the pulse motor circuit 32*d* is actuated to rotate the pulse motor 31, thereby rotating the platen 1 and the pair of sheet ejecting rollers 11 and 12. This allows the sheet to be moved forwardly while being held by the platen 1 and pinch roller 2. When the leading edge of the sheet has passed by the printing head 3 and between the paper bail 4 and the platen 1, the paper bail circuit 32*c* is actuated to set the paper bail 4. Thereafter, the sheet reaches the sheet leading edge detecting means 14*a* and 14*b*, and when the detecting means 14*a* and 14*b* detects the leading edge of the sheet, the printing initiating position setting circuit 32*e* is actuated to rotate the pulse motor 31 in the reverse direction. This rotates the platen 1 in the reverse direction to move the sheet rearwardly. In this case, the detecting means 14*a* and 14*b* detects the releasing of the leading edge of the sheet from the detecting means 14*a* and 14*b* and produces a signal to rotate the platen 1 in the reverse direction through a predetermined angle by using the signal as a starting point. Thus, the leading edge of the sheet moves rearwardly for a certain distance from the position in which it is released from the detecting means 14*a* and 14*b* to a new position where printing is initiated. By setting the certain distance at a predetermined value beforehand, it is possible to set a printing initiating position on the sheet which is spaced apart from the leading edge of the sheet a predetermined distance. Then printing is carried out by the printing head 3 and sheet is gradually moved along the sheet ejecting passage Q on the guide member 8 as printing progresses, until the sheet is ejected through the ejecting rollers 11 and 12 onto the sheet ejecting stacker 7.

Figure 4:
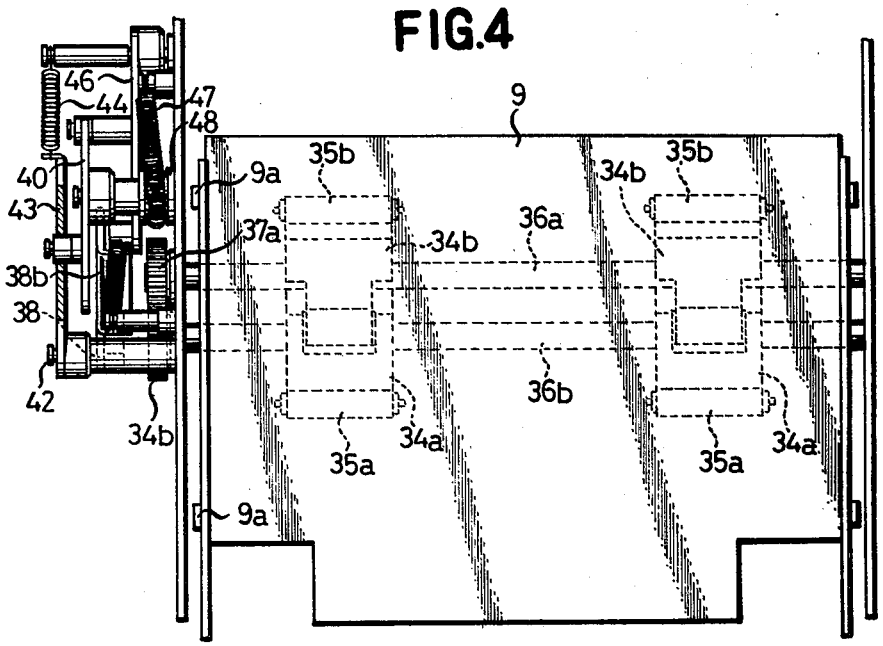
FIG. 4 is a plan view of the section of the system shown in FIG. 1 including the sheet support plate.
Figure 5:
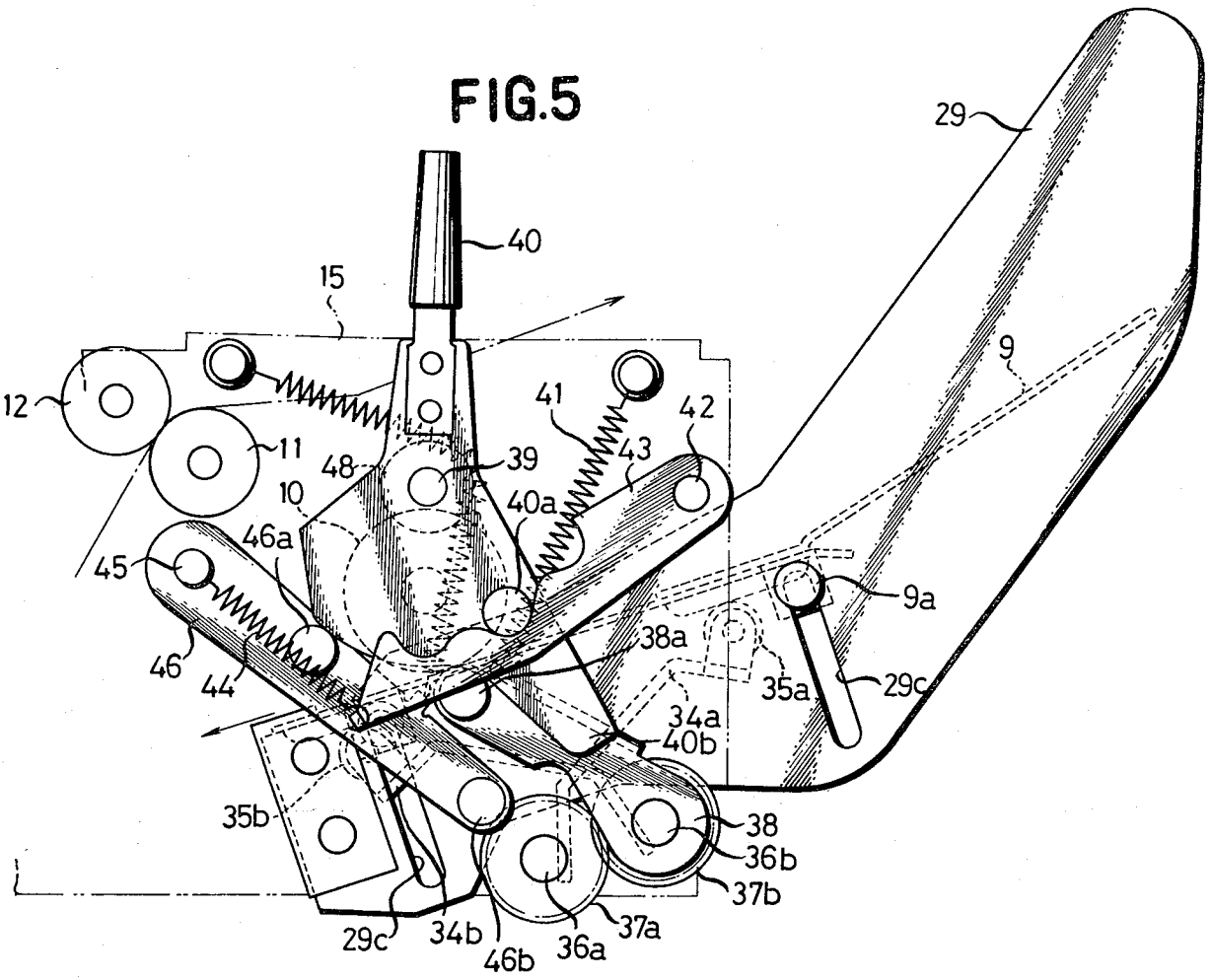
FIGS. 5–7 are views in explanation of the operation of the mechanism for moving the sheet support plate between upper and lower positions.

A mechanism for moving the sheet support plate 9 between its upper and lower positions will be described in detail. Referring to FIGS. 4 and 5, the sheet support plate 9 has pins 9*a* attached to either side thereof and engaged in slots 29*c* formed in guide side plates 29 so that the sheet support plate 9 can be maintained in a balanced position in moving vertically.

The sheet support plate 9 has, on either side of its undersurface, a pair of push-up levers 34*a* and 34*b*, having rollers 35*a* and 35*b* respectively at the forward end in engagement with the undersurface of the plate 9. The push-up levers 34*a* and 34*b* are secured at the base to parallel two shafts 36*a* and 36*b*, respectively, rotatably supported by the machine frame 15 and formed at one end thereof with gears 37*a* and 37*b* which are in meshing engagement with each other. One shaft 36*b* has secured thereto the base of a lever 38 for rotating the shaft 36*b*. The lever 38 has attached to its forward end a pin 38*a* which is positioned against an operating lever 40 pivotally supported by a shaft 39 connected to the machine frame 15. A first spring 41 is mounted at one end on the machine frame 15 and at the other end on the lever 38 to urge the lever 38 to move toward the operating lever 40.

The operating lever 40 has attached to its eccentric portion a pin 40*a* which is selectively in engagement with one of a plurality of cam recesses 43*a*, 43*b* and 43*c* (See FIG. 6) formed in a locking lever 43 pivotally supported at its base by a shaft 42 connected to the machine frame 15. A spring 44 is connected to the locking lever 43 to keep the pin 40*a* in engagement with one of the recesses 43*a*, 43*b* and 43*c*. The pin 38*a* attached to the forward end of the lever 38 is pressed and operated by a push-out cam surface 40*b* at the forward end of the operating lever 40.

Figure 6:
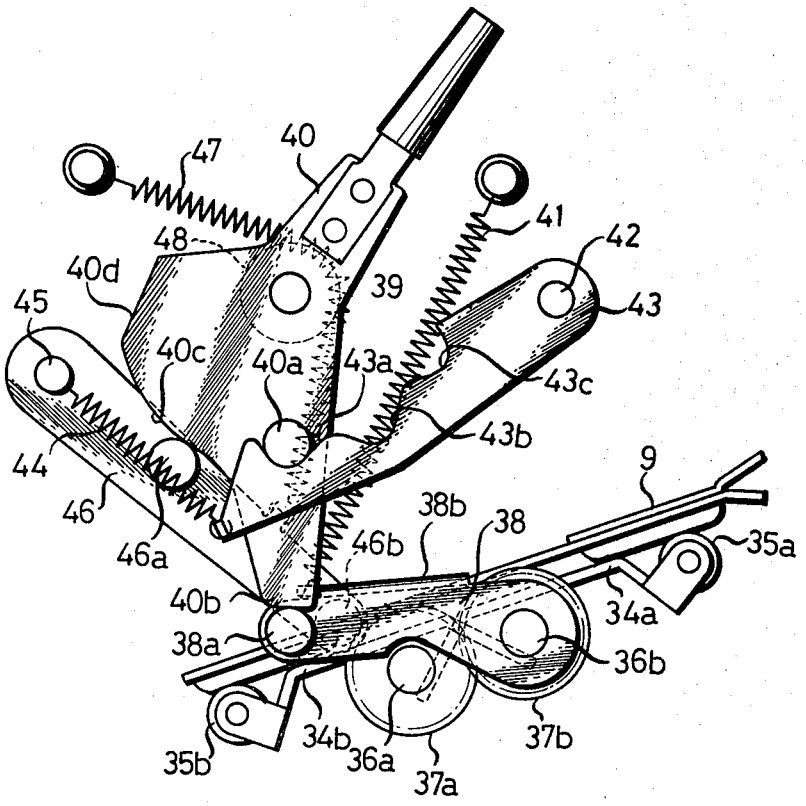

Operation of the sheet support plate moving mechanism of the aforesaid construction will be described. In FIG. 6, the pin 40*a* of the operating lever 40 is engaged in the cam recess 43*a* of the locking lever 43. In this condition, the push-out cam surface 40*b* of the operating lever 40 presses the pin 38*a* at the forward end of the lever 38 and rotates, through a predetermined angle, the shafts 36*a* and 36*b* through the gears 37*a* and 37*b*, to thereby move the pairs of push-up levers 34*a* and 34*b* on both sides of the sheet support plate 9 to a lying position. Thus the sheet support plate 9 is kept in the lower position.

Stated differently, there is a large clearance between the sheet feeding roller 10 and sheet support plate 9, to enable the sheets to be placed in a stack on the sheet support plate 9.

After the sheets are placed on the sheet support plate 9, the operating lever 40 is moved counterclockwise from the position shown in FIG. 6 to the position shown in FIG. 5 to bring the pin 40*a* into engagement in the cam resess 43*b*. This releases the pin 38*a* at the forward end of the lever 38 from pressing engagement with the push-out cam surface 40*b* of the operating lever 40, so that the lever 38 is moved clockwise, by the biasing force of the first spring 41, and the gear 37*b* is rotated to rotate the gear 37*a* in meshing engagement therewith. This rotates the shafts 36*a* and 36*b* inwardly to pivotally move the push-up levers 34*a* and 34*b* to an inclined position in which they form a letter V and move the sheet support plate 9 upwardly while being maintained in a balanced position by the pins 9*a* engaged in the slots 29*c* formed in the guide side plates 29.

Upward movement of the sheet support plate 9 brings the uppermost sheet of the stack of sheets thereon into pressing contact with the sheet feeding roller 10. The force with which the uppermost sheet is brought into pressing engagement with the sheet feeding roller 10 is the biasing force of first spring 41.

The sheets stacked on the sheet support plate 9 may vary in quality, some of them being hard and some being soft. When the sheets are hard, for example, the biasing force of first spring 41 may not be enough to force the uppermost sheet against the sheet feeding roller 10.

In this embodiment, a second spring is used in addition to the first spring 41 to increase the force with which the sheet support plate 9 is urged to move upwardly. The use of the second spring will be described.

Besides the push-out cam surface 40*b* for pressing against the pin 38*a* at the forward end of the lever 38, the operating lever 40 is formed with a restraining cam surface 40*c* continuous with the push-out cam surface 40*b* and a restraint releasing cam surface 40*d* continuous with the restraining cam surface 40*c*. An intermediate pin 46*a* of a restraining lever 46 supported at the base for pivotal movement by a shaft 45 connected to the machine frame 15 is positioned against the restraining cam surface 40*c*, and the restraining lever 46 has attached to its forward end a pin 46*b* which is positioned against a follower edge 38*b* of the lever 38 for push-up movement. The second spring 47 mounted at one end on the machine frame 15 and at the other end on the restraining lever 46 urges by its biasing force the restraining lever 46 to move toward the operating lever 40, 48 is a guide for the second spring 47.

Figure 7:
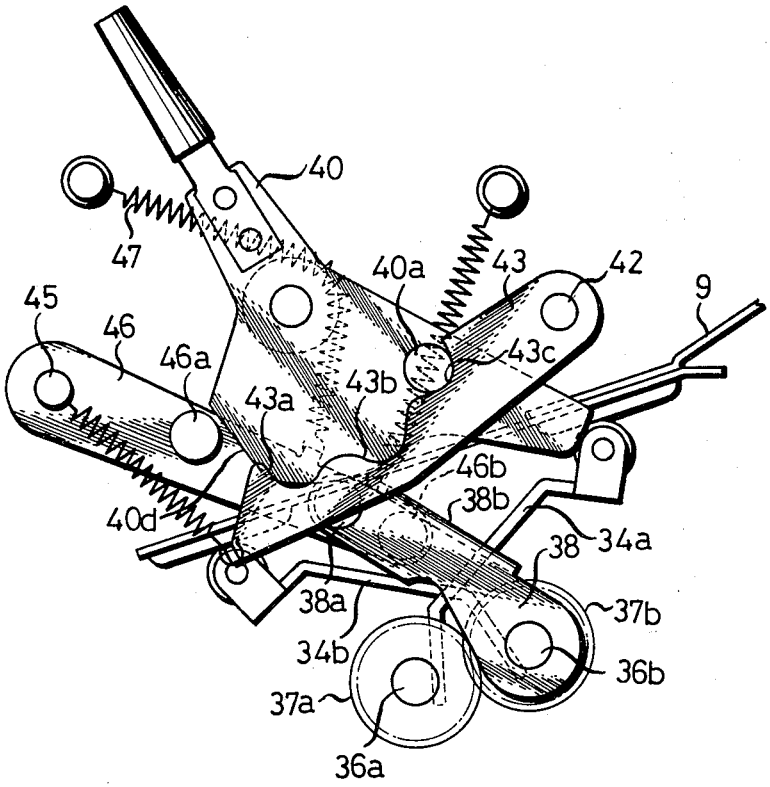

In operation, when the sheet support plate 9 is in the upper position shown in FIG. 5 and the uppermost sheet is in pressing engagement with the sheet feeding roller 10 by virtue of the biasing force of first spring 41, the operating lever 40 is further moved counterclockwise to a position shown in FIG. 7 to move the pin 40*a* into engagement in the cam recess 43*c*. When the sheet support plate 9 is in either of the positions shown in FIGS. 5 and 6, the intermediate pin 46*a* of the restraining lever 46 is positioned against the restraining cam surface 40*c* and the restraint releasing cam surface 40*d* of the operating cam 40 and the restraining lever 46 is prevented from moving in pivotal movement in spite of the fact that the biasing force of the second spring 47 is in action. Thus, it will be appreciated that the second spring 47 connected to the restraining lever 46 does not contribute to moving the sheet support plate 9 to its upper position as shown in FIG. 5.

Upon the operating lever 40 being pivotally moved into a position shown in FIG. 7, the intermediate pin 46*a* of the restraining lever 46 is moved from the cam surface 40*c* to a position displaced from the cam surface 40*d*. This permits the restraining lever 46 to be moved counterclockwise about the shaft 45 by the biasing force of second spring 47, so that the pin 46*b* at the forward end of the lever 46 presses the follower edge 38*b* of the lever 38 to move upwardly, thereby enabling the biasing force of second spring 47 to be added to the biasing force of first spring 41 to increase the force with which the sheets on the sheet support plate 9 press against the sheet feed roller 10.

It would be advantageous if the pair of guide side plates 29 each disposed on one side of the sheet support plate 9 were adjustable to conform to the width of the particular sheets handled. The end can be attained as follows in the embodiment of the invention described hereinafter.

Figure 8:
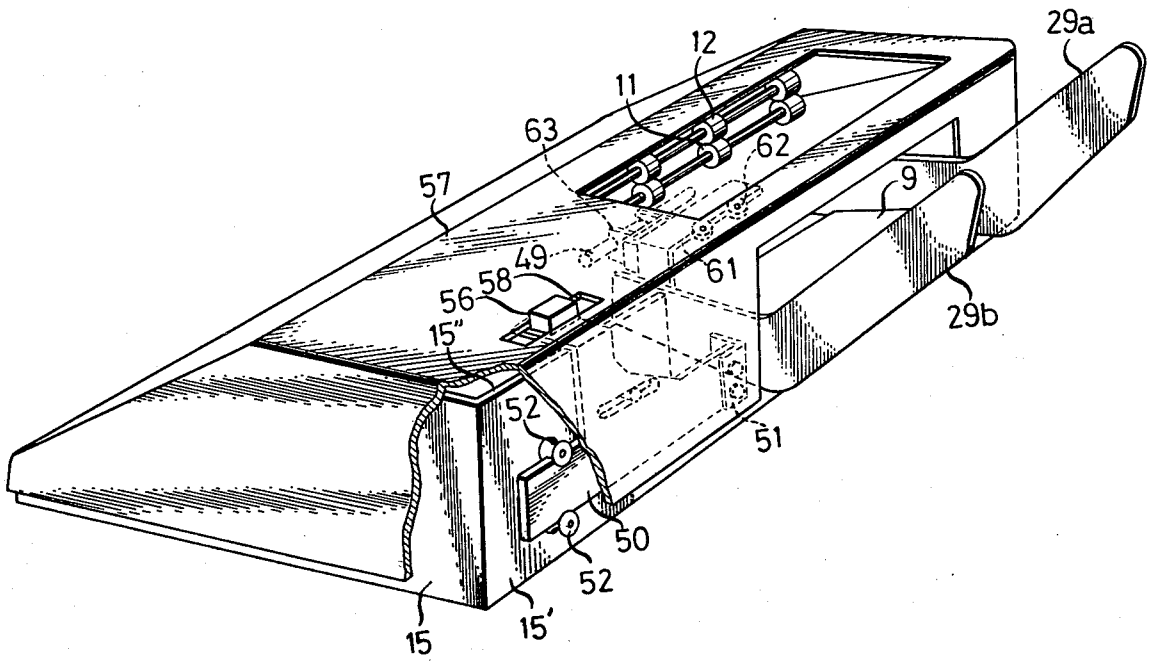
FIG. 8 is a perspective view, with a part of the cover being cut out, of the spacing adjusting mechanism for the guide side plates.
Figure 9:
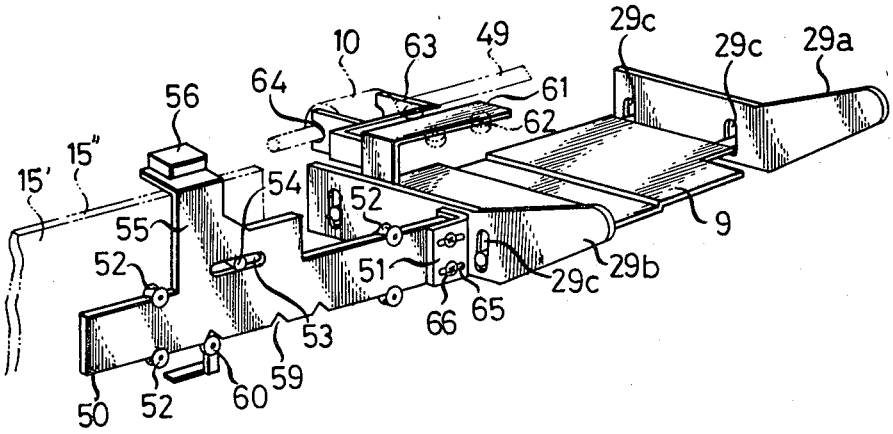
FIG. 9 is a perspective view of the spacing adjusting mechanism with the cover being removed.
Figure 10:
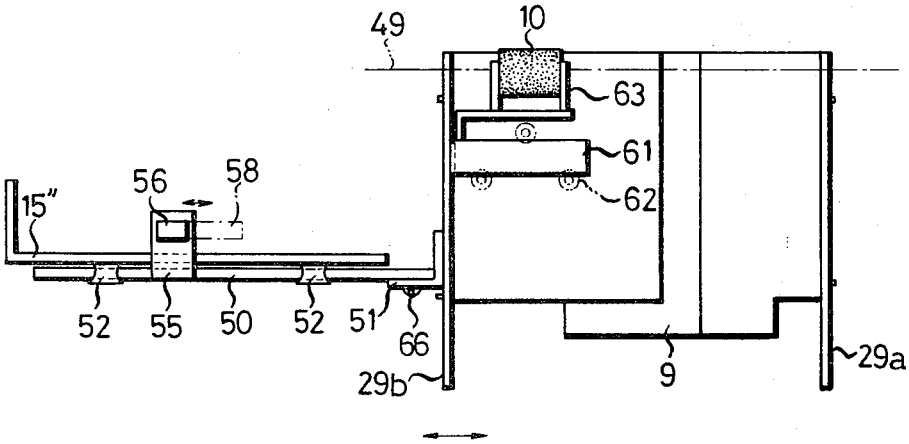
FIG. 10 is a plan view of the mechanism shown in FIG. 9.

Referring to FIGS. 8–10, one guide side plate 29*a* is secured to the machine frame and the other guide side plate 29*b* is supported by a guide rod 49 secured to the machine frame 15 for movement with the guide frame 49 guiding its movement. The sheet support plate 9 is supported for vertical movement by the guide plates 29*a* and 29*b* through the pins 9*a* received in the slots 29*c* as aforesaid. In view of the movement of the other guide side plate 29*b*, the sheet support plate 9 consists of two portions which are connected together to form an overlapping portion in the center.

The movable guide side plate 29*b* is secured at its outer surface on side thereof to a movable plate 50 of large thickness through a mounting member 51. The movable plate 50 is supported by a frame surface 15' extending perpendicular to the guide side plate 29*b* and parallel to the direction of movement of the movable guide side plate 29*b*.

The movable plate 50, as shown in FIG. 9, is engaged at its upper and lower edges by a plurality of grooved rollers 52 mounted on the frame surface 15' to be supported thereby for sliding movement, and guided by a pin 54 projecting from the frame surface 15' and received in a slot 53 formed in the movable plate 50.

The movable plate 50 includes an arm plate 55 of the L-shape projecting therefrom upwardly. The arm plate 55 includes a horizontal portion slidably engaging at its underside an upper edge 15'' of the frame surface 15' and having mounted at its surface an operating knob 56 which extends through an opening 58 (see FIG. 8) formed in a case 57 fitted over the frame 15.

The movable plate 50 is formed at its lower edge with a plurality of engaging notches 59 for positioning the plate 29*b* corresponding to the standard sizes of the sheets for allowing a locking member 60 formed of resilient material in the frame 15 to be selectively engaged therein.

The movable guide plate 29*b* has attached thereto an auxiliary movable plate 61 which projects from the side of the plate 29*b* toward the fixed guide side plate 29*a*. The auxiliary movable plate 61 is engaged at its side edge by grooved rollers 62 attached to the machine frame 15 to be guided thereby. The auxiliary movable plate 61 is formed integrally with a bracket 63 for supporting the sheet feeding roller 10 which is formed at its forward end with a guide portion 64 fitted over the guide rod 49, so that the guide rod 49 can be supported by the guide side plate 29*b*.

As a means for connecting the mounting member 51 to the movable plate 50, the mounting member 51 is formed with a slot 65 which receives therein an adjusting screw 66 connected to the movable plate 50. By operating this adjusting screw 66, it is possible to adjust the connection between the guide side plate 29*b* and the movable plate 50 so as to effect fine adjustments of the spacing interval between the guide side plates 29*a* and 29*b* to accomodate variations in the width of the sheets handled.

In operation, upon pushing or pulling the knob 56, the movable plate 50 moves parallel to the frame surface 15' and at the same time the guide side plate 29*b* connected to the movable member 50 is guided by the guide rod 49 to move toward or away from the guide side plate 29*a*. Thus the spacing interval between the two guide side plates 29*a* and 29*b* can be adjusted.

The spacing between the two guide side plates 29*a* and 29*b* can be set as the locking member 60 is engaged in one of the engaging notches 59 formed in the movable plate 50.

In the prior art, the guide side plate 29*b* has hitherto been moved by hand to effect adjustments of the spacing between the plates 29*a* and 29*b*. This arrangement has had the disadvantage that since a member slidably supporting the guide side plate 29*b* and a member on which the force of the guide side plate 29*b* acts are spaced apart from each other, biasing moment acts on the support member and sliding movement of the guide side plate is not performed smoothly. This defect has become pronounced when there is play in the engaging members due to a lack of precision at the time of fabrication. In addition, the guide side plate 29*b* has hitherto been moved by the operator by using as a guide a mark put to a suitable position when it is desired to set the spacing interval of the guide side plates in accordance with the size of the particular sheets handled. This arrangement has been unable to correctly adjust the spacing interval of the guide side plates, making it impossible to smoothly feed sheets to the sheet support plate 9.

The mechanism provided by the invention obviates the aforesaid disadvantage of the prior art. The movable guide side plate 29*b* is connected at its outer surface of one side thereof to a movable plate provided with a knob and disposed parallel to the frame for sliding movement along it, so that the movement of the guide side plate 29*b* is effected through the movable plate 50 guided by the frame. This avoids application of biasing moment on the guide side plate 29*b* and makes it possible to move it with a small force.

The engaging portion for effecting positioning is formed integrally with the movable plate provided with the knob. This arrangement permits engagement of the locking member in the engaging portion to be positively transmitted to the knob and permits operation to be performed without overrunning. It will be appreciated that the mechanism for adjusting the spacing interval between the guide side plates 29 according to the invention can achieve excellent effects in operation.

As described hereinabove, when it is desired to effect manual printing, the cover 17 is opened and a sheet is inserted through the slit 28 formed in the guide member 8 for manually inserting a sheet therethrough so that the sheet can be fed on the platen 1. When this manual insertion of sheet is effected, it is desirable that the sheet be ejected onto the cover 17 after being printed because difficulties are experienced in withdrawing the printed sheet if it is delivered through the sheet ejecting passage Q to the sheet ejecting stacker 7. However, when the cover 17 is in an open position it is away from the sheet ejecting passage Q, so that the printed sheet may not be ejected advantageously onto the cover 17. The mechanism according to the invention which obivates the aforesaid disadvantage of the prior art will not be described.

Figure 11:
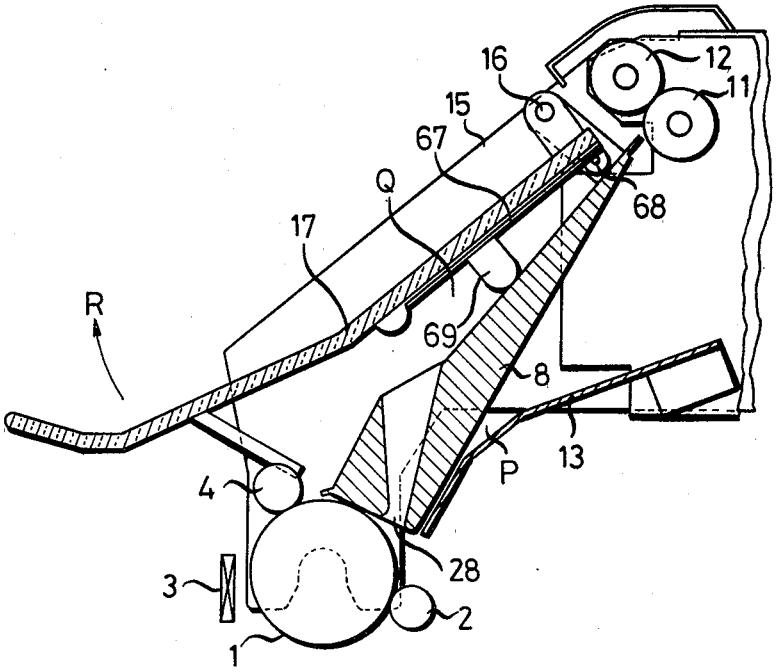
FIG. 11 is a schematic sectional view of a modification of the sheet ejecting passage of the automatic sheet feeding system shown in FIG. 1.

Referring to FIG. 11, the cover 17 has disposed below its undersurface a blocking member 67 having two legs 69 each on one of opposite sides and pivotally supported by a shaft 68. When the cover 17 is in its closed position as shown in FIG. 11, the legs 69 abut against the surface of the guide member 8 to keep the blocking member 67 away from the guide member 8 and permit the sheets ejected from the platen 1 to move smoothly through the sheet ejecting passage Q on the surface of the guide member 8.

Figure 12:
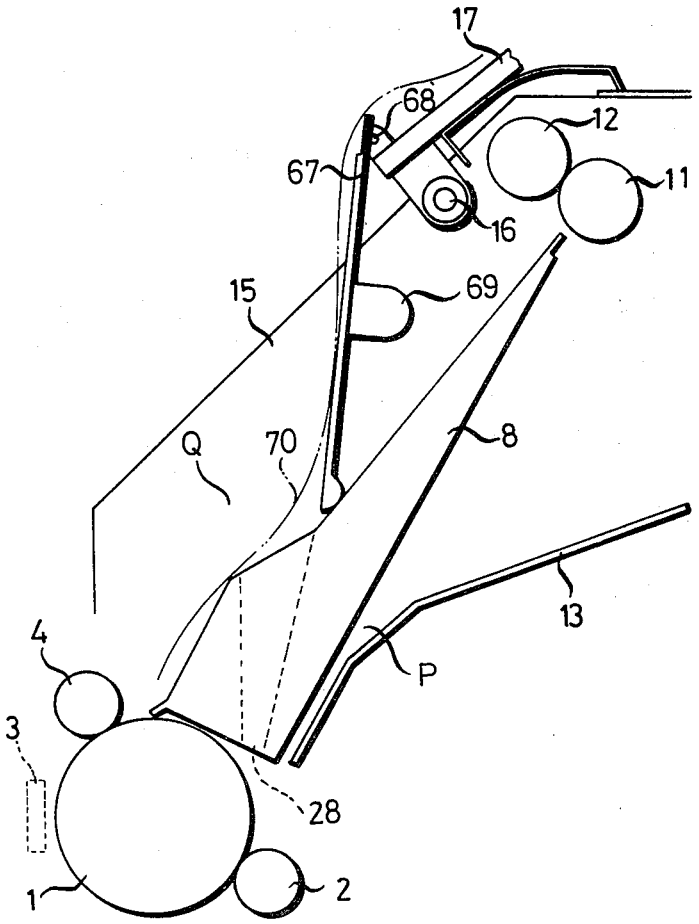
FIG. 12 is a view in explanation of the modification of sheet ejecting passage shown in FIG. 11.

When the cover 17 is moved upwardly about the support shaft 18 in the direction of an arrow R in FIG. 11 to its open position shown in FIG. 12, the blocking member 67 assumes a position shown in FIG. 12 because the shaft 68 moves about the shaft 16. With the blocking member 67 in the position shown in FIG. 12, the legs 69 are away from the guide member 8 but the forward end of the blocking member 67 is brought into contact with the surface of the guide member 8, thereby blocking the sheet ejecting passage Q and enabling the printed sheet to be ejected onto the cover 17 in the open position. That is, the printed sheet 70 released from the platen 1 after the sheet is inserted through the slit 28 is delivered midway in the sheet ejecting passage Q by the blocking member 67 to the cover 17 in the open position where the printed sheet 70 can be readily handled by the operator.

Figure 13:
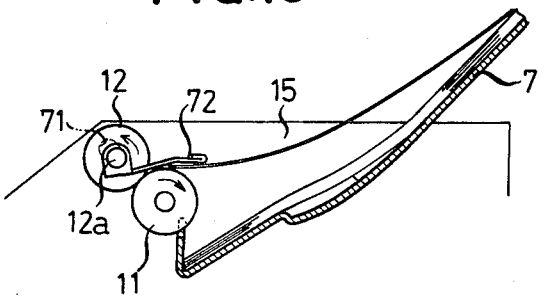
FIG. 13 is a schematic sectional view of another modification of the sheet ejecting mechanism.
Figure 14:
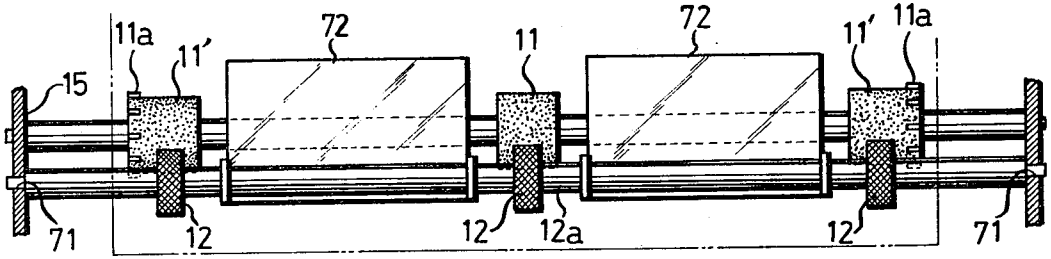
FIG. 14 is a plan view of the sheet ejecting mechanism shown in FIG. 13.

In the mechanism shown in FIGS. 13 and 14, a shaft 12*a* supporting the follower roller 12 forming a pair with the drive roller 11 for ejecting printed sheets is engaged in a slot 71 formed in the frame 15 and having its longitudinal dimension substantially extending vertically to enable the follower roller 12 to move toward and away from the drive roller 11. The shaft 12*a* has secured thereto a tongue 72 for pivotal movement, the tongue 72 including a forward end portion extending from the base and positioned on the delivery side of the drive roller 11 by its own weight.

In operation, when a sheet clears the sheet ejecting rollers 11 and 12, the weight of the tongue 72 acts on the sheet as shown in FIG. 13 even if the trailing edge of the sheet has passed the center line connecting the axes of the two rollers 11 and 12. Thus, the sheet is forced against the drive roller 11 by the weight of the tongue 72, thereby enabling the sheet to be positively released from the rollers 11 and 12.

Figure 15:
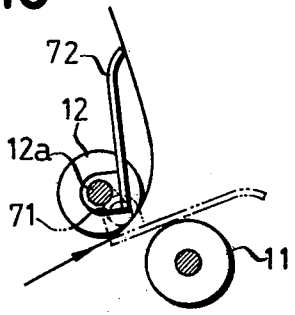
FIG. 15 is a view in explanation of the operation of the sheet ejecting mechanism shown in FIGS. 13 and 14.

In the mechanism described hereinabove, the follower roller 12 is supported for movement toward and away from the drive roller 11 and the tongue 72 is pivotally connected to the shaft 12*a* of the follower roller 12. By this arrangement, it is possible to grip the leading edge of the jammed sheet by hand and turn it toward the follower roller 12 as shown in FIG. 15, so that the sheet moves the tongue 72 in pivotal movement and lifts the follower roller 12. In this condition, the follower roller 12 is away from the drive roller 11 and no force acts on the sheet to hold them between the rollers 11 and 12, thereby enabling the sheet to be readily removed from between the rollers 11 and 12. The mechanism described above is simple in construction but high in practical value.

Figure 16:
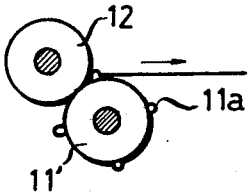
FIG. 16 is a view in explanation of a modification of the sheet ejecting roller.

The outermost member 11' of the drive roller 11 may be formed on the outer side of its circumferential surface with a plurality of projections 11*a* resembling the teeth of a gear. A sheet can be positively released from the sheet ejecting rollers 11 and 12 as one of the projections 11*a* pushes the trailing edge of the sheet as shown in FIG. 16.

Figure 17:
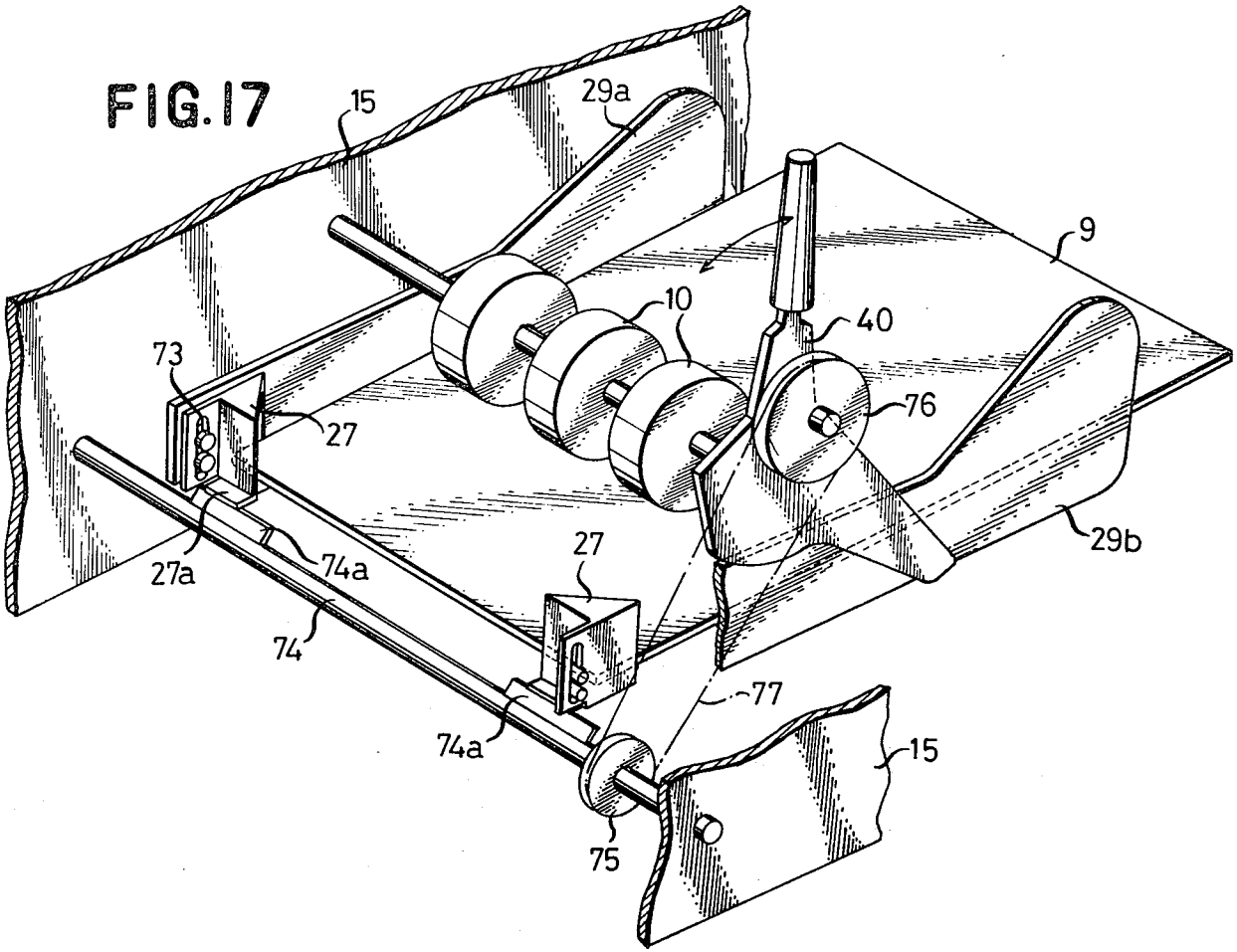
FIG. 17 is a perspective view of the separation claw mechanism according to the invention.

FIG. 17 shows a mechanism in which the separation claws 27 each disposed along one side of the sheet support plate 9 near the front end thereof are supported for vertical movement through slits 73 by the guide side plates 29*a* and 29*b* respectively located on opposite sides of the sheet support plate 9 in upright positions and slidable widthwise of the sheets on the sheet support plate 9. The separation claws 27 are each formed with a projection 27*a* which overlies a projection 74*a* formed on a rotary shaft 74 mounted on the frame 15 having attached thereto a pulley 75. The operating lever 40 has mounted at its pivot a pulley 76, and a cord 77 is trained over the two pulleys 75 and 76.

Figure 18:
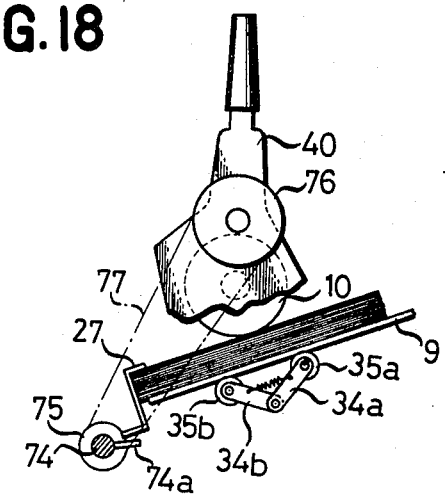
FIGS. 18 and 19 are views in explanation of operation of the separation claw mechanism shown in FIG. 17.
Figure 19:
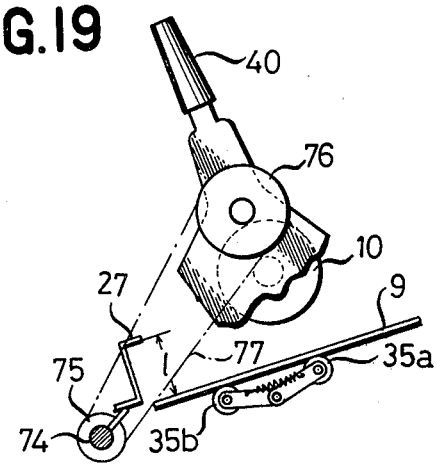

In operation, if the operation lever 40 disposed in the position shown in FIG. 18 is moved counterclockwise to place a stack of sheets on the sheet support plate 9, then the sheet support plate 9 moves downwardly to a position in which sheets can be placed thereon as shown in FIG. 19. At the same time, the counterclockwise movement of the operating lever 40 rotates the rotary shaft 74 in one direction through the cord 77, so that the projections 74*a* press and move upwardly the projections 27*a* to thereby move the separation claws 27 upwardly. As a result a large clearance l is formed between the separation claws 27 and the sheet support plate 9. Thus when sheets are placed on the sheet support plate 9 with the claws 27 in this position, the leading edges of the sheets fed from the rear of the plate 9 do not catch against the separation claws 27.

After the sheets are placed on the sheet support plate 9, the operating lever 40 is moved clockwise to return the sheet support plate 9 from the position shown in FIG. 19 to the position shown in FIG. 18. Rotation of the rotary shaft 74 in the reverse direction releases the projections 74*a* from engagement with the projections 27*a* of the separation claws 27, thereby allowing the separation claws 27 to move downwardly by their own weights to predetermined separation positions.

The mechanism described hereinabove allows the separation claws 27 to move between their operative and inoperative positions in conjunction with the vertical movement of the sheet support plate 9 which must be performed when sheets are placed thereon. The mechanism eliminates the need to operate the separation claws 27 independently of the operation of placing a stack of sheets on the sheet support plate 9, as has hitherto been the case with the prior art.

What is claimed is:

1. In an automatic sheet feeding system of a printing apparatus for feeding sheets of a stack one after another, the printing apparatus comprising a platen, a printing head arranged on a front side of the platen and movable axially of the platen, a sheet ejecting stacker disposed rearwardly of the platen and a sheet feeding stacker disposed rearwardly of the platen and underlying the sheet ejecting stacker, the improvement comprising:

a guide member disposed close to the platen in such a manner that a sheet ejecting passage connected to the sheet ejecting stacker is formed at the upper side of said guide member and a sheet feeding passage connected to the sheet feeding stacker is formed at the lower side of said guide member, said guide member having a slit therein for receiving manually inserted sheets, said slit having an inlet end intermediate the upper and lower side of said guide member and an outlet end adjacent the lower side of said guide member;

a sheet feeding roller;

a motor for driving said sheet feeding roller for feeding one sheet after another from the sheet feeding stacker;

a pinch roller cooperating with the platen for feeding the sheet therebetween; and a transmission means for transmitting rotation from a drive of the printing apparatus to the platen, so that rotation of the platen is initiated only after the leading edge of a sheet fed by the sheet feeding roller has butted against a holding section formed between the platen which remains stationary and the pinch roller.

2. An automatic sheet feeding system as claimed in claim 1, wherein the printing apparatus comprises a machine frame and said guide member is pivotally connected to the machine frame.

3. An automatic sheet feeding system as claimed in claim 2, further comprising sheet leading edge detecting means mounted at the inlet of the sheet ejecting passage near the platen, and means for rotating said platen in the reverse direction through a predetermined angle when said detecting means detects the leading edge of a sheet.

4. An automatic sheet feeding system as claimed in claim 3, wherein said sheet leading edge detecting means detects release of the leading edge from the detecting means when the sheet is moved rearwardly and produces a signal to rotate the platen in the reverse direction through a predetermined angle by using said signal as a starting point.

5. In an automatic sheet feeding system of a printing apparatus for feeding sheets of a stack one after another, the printing apparatus comprising a platen, a printing head arranged on a front side of the platen and movable axially of the platen, a sheet ejecting stacker disposed rearwardly of the platen and a sheet feeding stacker disposed rearwardly of the platen and underlying the sheet ejecting stacker, the improvement comprising:

a guide member disposed close to the platen in such a manner that a sheet ejecting passage connected to the sheet ejecting stacker is formed at the upper side of said guide member and a sheet feeding passage connected to the sheet feeding stacker is formed at the lower side of said guide member;

a sheet feeding roller;

a motor for driving said sheet feeding roller for feeding one sheet after another from the sheet feeding stacker;

a pinch roller cooperating with the platen for feeding the sheet therebetween;

a transmission means for transmitting rotation from a drive of the printing apparatus to the platen, so that rotation of the platen is initiated only after the leading edge of a sheet fed by the sheet feeding roller has butted against a holding section formed between the platen which remains stationary and the pinch roller; and a sheet support plate disposed for vertical movement below the sheet feeding roller adapted to cooperate with the sheet feeding stacker, and a machine frame mounted to said sheet support plate for supporting the forward portion of a stack of sheets on the sheet feeding stacker, a plurality of pairs of push-up levers each disposed on one of opposite sides and maintained in resilient engagement with the undersurface of said sheet support plate, and an operating lever connected to the machine frame for moving said push-up levers between a lying position and an inclined position.

6. An automatic sheet feeding system as claimed in claim 5, wherein the improvement further comprises a first spring connected to the sheet support plate and urging the sheet support plate into pressing engagement with the sheet feeding roller by its biasing force, and a second spring urging by its biasing force the push-up levers to resiliently engage the undersurface of the sheet support plate to increase the force with which the sheet support plate presses against the sheet feeding roller.

7. An automatic sheet feeding system as claimed in claim 5, wherein the improvement further comprises a pair of guide side plates supporting the sheet support plate for vertical movement, at least one of said guide side plates being movable, a movable plate connected to the movable guide side plate disposed for sliding movement parallel to the direction of movement of the movable guide side plate, a knob connected to the movable plate and operable from outside, a plurality of engaging portions formed in the movable plate, and a locking member connected to the machine frame and adapted to come into locking engagement with one of the engaging portions to set the movable guide side plate in a desired position.

8. In an automatic sheet feeing system of a printing apparatus for feeding sheets of a stack one after another, the printing apparatus comprising a platen, a printing head arranged on a front side of the platen and movable axially of the platen, a sheet ejecting stacker disposed rearwardly of the platen and a sheet feeding stacker disposed rearwardly of the platen and underlying the sheet ejecting stacker, the improvement comprising:

a guide member disposed close to the platen in such a manner that a sheet ejecting passage connected to the sheet ejecting stacker is formed at the upper side of said guide member and a sheet feeding passage connected to the sheet feeding stacker is formed at the lower side of said guide member;

a sheet feeding roller;

a motor for driving said sheet feeding roller for feeding one sheet after another from the sheet feeding stacker;

a pinch roller cooperating with the platen for feeding the sheet therebetween;

a transmission means for transmitting rotation from a drive of the printing apparatus to the platen, so that rotation of the platen is initiated only after the leading edge of a sheet fed by the sheet feeding roller has butted against a holding section formed between the platen which remains stationary and the pinch roller; and a pair of sheet ejecting rollers consisting of a drive roller and a follower roller in contact with the drive roller for ejecting onto the sheet ejecting stacker a sheet delivered thereunto through the sheet ejecting passage, said follower roller being movable into and out of engagement with the drive roller, and a tongue pivotally connected to a shaft for supporting the follower roller and coming into contact by its own weight with the sheet ejected by the pair of sheet ejecting rollers so as to force the sheet against the drive roller.

9. In an automatic sheet feeding system of a printing apparatus for feeding sheets of a stack one after another, the printing apparatus comprising a platen, a printing head arranged on a front side of the platen and movable axially of the platen, a sheet ejecting stacker disposed rearwardly of the platen and a sheet feeding stacker disposed rearwardly of the platen and underlying the sheet ejecting stacker, the improvement comprising:

a guide member disposed close to the platen in such a manner that a sheet ejecting passage connected to the sheet ejecting stacker is formed at the upper side of said guide member and a sheet feeding passage connected to the sheet feeding stacker is formed at the lower side of said guide member;

a sheet feeding roller;

a motor for driving said sheet feeding roller for feeding one sheet after another from the sheet feeding stacker;

a pinch roller cooperating with the platen for feeding the sheet therebetween;

a transmission means for transmitting rotation from a drive of the printing apparatus to the platen, so that rotation of the platen is initiated only after the leading edge of a sheet fed by the sheet feeding roller has butted against a holding section formed between the platen which remains stationary and the pinch roller; and a pair of guide side plates, a sheet support plate mounted for vertical movement between the pair of guide side plates, a pair of separation claws each mounted for vertical movement at a front edge portion of one of the pair of guide side plates and movable between a position in which they are in engagement with the uppermost sheet of a stack of sheets on the sheet support plate and a position in which they are out of engagement therewith, a plurality of pairs of push-up levers resiliently urged to move the sheet support plate into pressing engagement with the sheet feeding roller, an operating lever for moving the sheet support plate to a lower position for enabling sheets to be placed thereon, and means for moving the separation claws to the position in which they are out of engagement with the uppermost sheet of the stack of sheets on the sheet support plate, said means being controlled by the operating lever, so that when the operating lever is in a sheet supply position the separation claws are conjointly moved through said means to the position in which they are out of engagement with the uppermost sheet of the stack of sheets on the sheet support plate.

10. In an automatic sheet feeding system of a printing apparatus for feeding sheets of a stack one after another, the printing apparatus comprising a platen, a printing head arranged on a front side of the platen and movable axially of the platen, a sheet ejecting stacker disposed rearwardly of the platen and a sheet feeding stacker disposed rearwardly of the platen and underlying the sheet ejecting stacker, the improvement comprising:

a guide member disposed close to the platen in such a manner that a sheet ejecting passage connected to the sheet ejecting stacker is formed at the upper side of said guide member and a sheet feeding passage connected to the sheet feeding stacker is formed at the lower side of said guide member;

a sheet feeding roller;

a motor for driving said sheet feeding roller for feeding one sheet after another from the sheet feeding stacker;

a pinch roller cooperating with the platen for feeding the sheet therebetween;

a transmission means for transmitting rotation from a drive of the printing apparatus to the platen, so that rotation of the platen is initiated only after the leading edge of a sheet fed by the sheet feeding roller has butted against a holding section formed between the platen which remains stationary and the pinch roller; and a cover pivotally supported for movement between an open position and a closed position and cooperating with the guide member to define the sheet ejecting passage therebetween when disposed in the closed position, and a blocking member pivotally connected at one end to the cover, said blocking member being moved, when the cover is disposed in the closed position, to a position in which it does not block the sheet ejecting passage and moved, when the cover is in the open position, to a position in which the sheet in the sheet ejecting passage is led to the cover in the open position.

11. An automatic sheet feeding system as claimed in claim 10, wherein the improvement further comprises a sheet support plate disposed for vertical movement below the sheet feeding roller adapted to cooperate with the sheet feeding stacker, and a machine frame mounted to said sheet support plate for supporting the forward portion of a stack of sheets on the sheet feeding stacker, a plurality of pairs of push-up levers each disposed on one of opposite sides and maintained in resilient engagement with the undersurface of said sheet support plate, and an operating lever connected to the machine frame for moving said push-up levers between a lying position and an inclined position.

* * * * *